United States Patent [19]

Garner

[11] 4,187,921

[45] Feb. 12, 1980

[54] ROCK BIT COMBINATION TO ENHANCE CUTTINGS REMOVAL

[75] Inventor: Lloyd L. Garner, San Clemente, Calif.

[73] Assignee: Smith International, Inc., Newport Beach, Calif.

[21] Appl. No.: 965,647

[22] Filed: Dec. 1, 1978

[51] Int. Cl.[2] ..... E21B 9/08; E21C 7/06

[52] U.S. Cl. ..... 175/340; 175/65; 175/422

[58] Field of Search ..... 175/56, 65, 67, 339, 175/340, 393, 422; 134/1

[56] References Cited

U.S. PATENT DOCUMENTS

| | | | |
|---|---|---|---|
| 3,231,030 | 1/1966 | Blom | 175/65 |
| 3,315,755 | 4/1967 | Brooks | 175/56 |
| 3,402,075 | 9/1968 | Goldwasser et al. | 134/1 |
| 3,528,704 | 9/1970 | Johnson, Jr. | 175/67 X |
| 3,603,410 | 9/1971 | Angona | 175/56 |
| 4,068,731 | 1/1978 | Garner et al. | 175/339 |
| 4,071,097 | 1/1978 | Fulop et al. | 175/56 |

FOREIGN PATENT DOCUMENTS

| | | | |
|---|---|---|---|
| 2272255 | 1/1976 | France | 175/340 |
| 152212 | 12/1962 | U.S.S.R. | 175/339 |

*Primary Examiner*—James A. Leppink
*Assistant Examiner*—Richard E. Favreau
*Attorney, Agent, or Firm*—Robert G. Upton

[57] ABSTRACT

This invention teaches the use of one or more cavitation inducing nozzles in combination with conventional nozzles for rock bits. The cavitation nozzles enhance the drilling rate by rapidly removing cuttings from the hole bottom. Cavitation from a cavitating nozzle positioned on one side of the bit reduces the pressure thereby inducing drilling mud at higher pressure passing through an opposing non-cavitative nozzle to move across the rock-tooth interface. The resultant cross-flow rapidly removes the cuttings from the hole bottom.

2 Claims, 2 Drawing Figures

ROCK BIT COMBINATION TO ENHANCE CUTTINGS REMOVAL

BACKGROUND OF THE INVENTION

1. Field of the Invention

This invention relates to the drilling art and to the means in which the drill bit is advanced in a hole.

More particularly, this invention relates to a means to enhance the drilling rate of a conventional rock bit by utilizing at least one cavitation inducing nozzle in combination with conventional nozzles to induce cross-flow of drilling mud near the rock-tooth interface for more rapid removal of cuttings from the hole bottom.

2. Description of the Prior Art

The use of the cavitation phenomenon to erode solid material is taught in U.S. Pat. Nos. 3,528,704 and 3,713,699. The earlier '704 patent describes a method for utilizing the normally destructive forces of cavitation to provide an erosion effect for accomplishing drilling, boring and like functions of solids which comprise forming a fluid jet by directing the fluid through a restricted orifice at speeds sufficient to generate vapor-filled bubbles in the jet and impinging the jet against the solid at a distance from the orifice where the vapor bubbles collapse or implode.

The patent describes and illustrates fluid under pressure that is forced out of an exit opening which necks down from an upstream chamber. In most embodiments, a central concentric rod or pintle is introduced near the opening to induce cavitation as the liquid is forced out of the exit orifice. The resultant formation growth and collapse of vapor-filled cavities or "bubbles" in a flowing liquid that occurs at a level where local pressure is reduced below the vapor pressure of the liquid causes the erosion of the solid material. The implosion of the collapsing cavity happens with such violence it damages and erodes the material with which it comes into contact.

The later '699 prior art patent teaches a slight improvement in the destructive power of the cavitation phenomenon by surrounding the caviting jet with a liquid medium.

While the foregoing patents describe a means to excavate a hole, the cavitation erosion method is disadvantaged in that drilling rates are relatively slow when compared to the drilling rate of standard rock bits; such as, drag bits, one cone, or multi-cone rock bits.

It is known in the prior art to plug a nozzle opening in a rock bit opposite an opposing nozzle in the bit to induce cross-flow of liquid from one nozzle toward a plugged nozzle. Pressures, however, are generally constant in the hole bottom using this technique and the removal of rock chips is less effective.

The instant invention takes advantage of the pressure reducing characteristics of cavitating nozzle to induce cross-flow of drilling mud by placing a cavitating nozzle opposite a conventional nozzle. The mud passing through the conventional nozzle is at a higher pressure, hence the fluid moves toward the low pressure area, resulting in a cross-flow that rapidly removes the cuttings from the hole bottom.

The prior art heretofore described does not teach or suggest the combination of cavitating jets with conventional jets in rock bits.

SUMMARY OF THE INVENTION

It is an object of this invention to utilize a cavitating jet in combination with conventional jets in a rock bit.

More particularly, it is an object of this invention to use one or more cavitating jet nozzles in combination with conventional nozzles in extended nozzle two and three cone rock bits.

A rock bit is described which normally utilizes the hydraulic action of circulating drilling mud by directing the mud through one or more nozzles directed toward the hole bottom to aid the process of advancing the bit in the hole. The rock bit is improved by incorporating at least one cavitating jet nozzle in the rock bit, the cavitating jet nozzle being on one side of the bit. At least one non-cavitating jet nozzle is positioned on an opposite side of the bit, the drilling mud directed through the at least one cavitation inducing jet exits the jet at a lower pressure due to the cavitating fluid. The drilling mud exiting through the at least one non-cavitating jet at a higher pressure causes the drilling mud exiting the non cavitating jet to move across the rock tooth interface towards the lower pressure area adjacent the cavitating jet nozzle thereby rapidly removing cuttings from the hole bottom.

This concept particularly teaches how to utilize cavitating jet nozzles combined with conventional nozzles in two and three cone rock bits. The implode waves induced by the cavitating jet nozzles reduce the localized pressure near the bottom of the hole on one side of the bit while fluid from an opposite conventional nozzle sweeps across the rock-tooth interface due to its higher pressure, thereby rapidly removing the cuttings from the hole bottom. In addition, where a cavitating jet is placed in the dome of multi-cone rock bits, the resulting cavitation serves to clean the cones of the rock bit as it is advanced in the hole.

Therefore, an advantage over the prior art is the combination of the use of the cavitation phenomenon with conventional jet nozzles in single and multi-cone rock bits.

Yet another advantage over the prior art is the use of a cavitating jet nozzles in the dome of multi-cone rock bits to clean the cones as they are advanced in the hole.

Still another advantage over the prior art is the reduction of localized pressure at the rock-tooth interface, thus aiding in the removal of cuttings from the hole bottom.

The above noted objects and advantages of the present invention will be more fully understood upon a study of the following detailed description in conjunction with the detailed drawings.

FIG. 1 is a cross-section of a two cone rock bit with extended nozzles illustrating the cavitating nozzles placed in the bit dome and one of the extended nozzles, and FIG. 2 is a view looking up at the bottom of FIG. 1 illustrating the orientation of the three cavitating nozzles in the rock bit, the cones being shown in phantom line.

DESCRIPTION OF THE PREFERRED EMBODIMENTS AND BEST MODE FOR CARRYING OUT THE INVENTION

Figure 1:
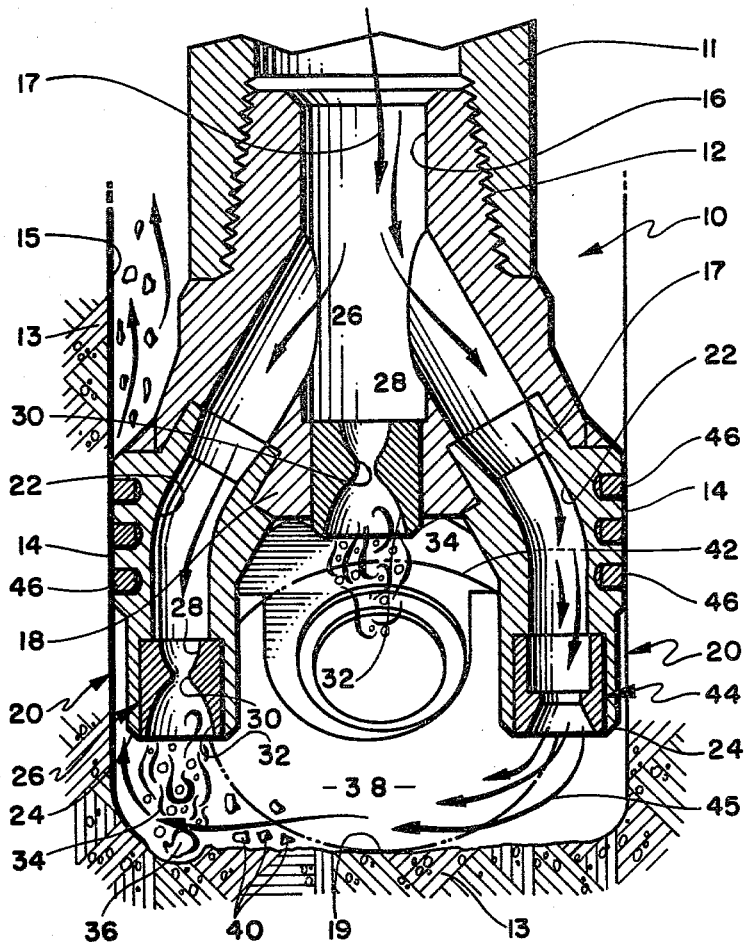
Figure 2:
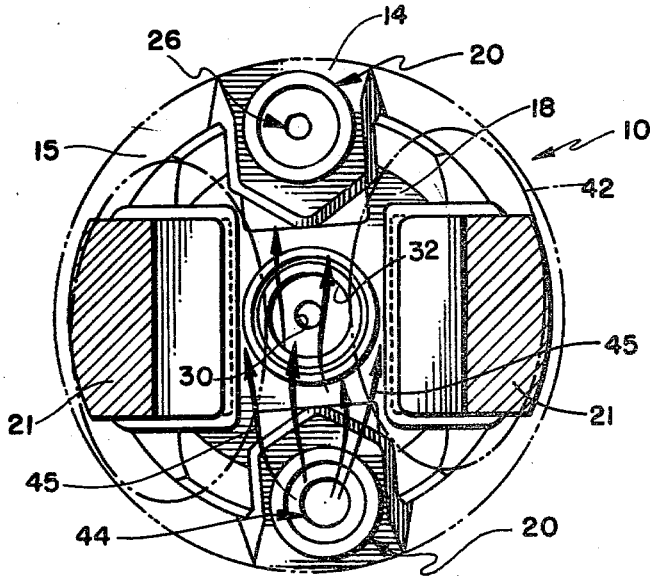

FIG. 1 illustrates a two cone rock bit, generally designated as 10. A pin segment 12 is normally threaded into a drill collar 11 which is part of a drill string (not shown). A pair of extended nozzle portions, generally designated as 20, extend down from the dome portion 18 of the rock bit 10. The cones 42 are journalled to rock bit legs 21 (FIG. 2). Four point stabilization is provided for the two cone rock bit by providing stabilizer bosses 14 on the extended nozzles 20. Tungsten carbide inserts 46 are commonly inserted in the stabilizer sections 21 to reduce wear in this area. The stabilizers 21 contacting the walls of the hole 15 stabilize the bit as the cutters 42 run on the hole bottom 19.

Unique cavitating nozzle bodies, generally designated as 26, are inserted in the base 24 of one of the nozzles 20. Each of the cavitating nozzles 26 consist of an upstream opening 28, a narrow throat segment 30 and a larger exit opening 32. The cross-section of the nozzle depicts a converging area upstream of throat 30 and a diverging section downstream of the throat forming a chamber thereby. The opposite extended nozzle 20 has a conventional nozzle, generally designated as 44. The cavitating nozzle 26 and the conventional nozzle 44 positioned in base 24 of nozzles 20 are positioned relatively close to the hole bottom 19. An additional cavitating nozzle 26 is positioned in the dome 18 of the two cone rock bit 10.

Hydraulic mud 17 is directed down the drill string (not shown) through conduit 16 and drill bit 10. The hydraulic mud stream 17 is diverted through separate passage ways 22 in each of the extended nozzles 20. In addition, a portion of the mud is directed through the center cavitating jet nozzle 26 upstream of the cone segments 42. As the mud enters upstream opening 28 under pressure it is accelerated through throat segments 30 and rapidly expanded towards the enlarged downstream exit opening 32 thereby inducing cavitation to the mud as it exits opening 32 of the cavitating nozzles 26.

Referring specifically to the cavitating nozzles 26 in one of the extended nozzles 20, as the cavitating liquid or mud exits opening 32 the expanded bubbles, as they approach the hole bottom 19, are compressed by ever increasing surrounding pressure and they catastrophically implode in area 36 adjacent the bottom of the hole 19, thereby eroding the hole bottom in the implosion area. In addition to the erosion caused by the implosion inducing cavitating jet nozzles, the localized pressure 38 at the rock-tooth interface is reduced near the bottom of the hole, thereby aiding the removal of cuttings 40 from the bottom of the hole. Thus the rock bit will substantially be traversing new material in the hole bottom instead of regrinding the old cuttings. Since there is a conventional nozzle 44 in an opposite extended nozzle 20 and the liquid is passing through the nozzle at substantially laminar flow the stream therefore is at a higher pressure. The mud thus moves across the rock-tooth interface towards the lower pressure area adjacent the opposite cavitating nozzle thus sweeping the hole bottom clean of rock chips in the cross-flow.

The center cavitating jet nozzle 26 of FIG. 1 serves a different purpose. The cavitating nozzle being upstream of the rolling cones 42 serves to clean the cones as they are advanced in the hole, thus preventing balling of the cones, thereby preventing severe damage to the rock bit 10. Center jet 26 induces cavitation and the resultant agitation caused by the implosion near the surface of the cones tends to clean the cones more thoroughly than a conventional jet nozzle. Conventional jet nozzles, on the other hand, sometimes emit a solid stream of accelerated mud through the nozzle, thus actually cutting the surface of the rolling cones as they work in the bottom of the hole. The cavitation phenomenon, since it basically is an agitating type of action, does not hydraulically cut the cones during operation of the rock bit 10.

FIG. 2 illustrates the alignment of the two extended nozzles with a cavitating jet nozzle 26 in one side and the conventional nozzle 44 in the other, with the center cavitating jet positioned in the dome 18 of the rock bit 10. Cones 42, journalled to legs 21, intermesh, one with the other, and the center jet 26 is important in that it prevents balling of the cones as heretofore described. It is readily evident that the extended nozzles 20 do not in any way interfere with the cones 42. Thus, the cavitating stream exiting the cavitation inducing jets 26 impinge directly on the bottom 19 of hole 15 while reducing the pressure adjacent the nozzle (FIG. 1). The opposite conventional nozzle 44 emits liquid at a higher pressure and the fluid moves along path 45 toward the low pressure area thereby removing cuttings from the hole bottom.

The combination of the cavitation inducing jet with the multicone rock bit produces a rock bit which has an unusual drilling rate. In addition, the attendant pressure reduction facilitates more rapid flushing of cuttings in the hole bottom, further resulting in a drill bit which is highly efficient.

The cross-flow feature heretofore described will obviously function in different types of bits. For example, a drag bit (not shown) could incorporate cavitating and conventional jet nozzle on opposite sides of the bits to induce cross-flow across the rock-tooth interface to clean the hole bottom.

It will of course be realized that various modifications can be made in the design and operation of the present invention without departing from the spirit thereof. Thus, while the principal preferred construction, and mode of operation of the invention have been explained and what is now considered to represent its best embodiments has been illustrated and described, it should be understood that within the scope of the appended claims the invention may be practiced otherwise than as specifically illustrated and described.

I claim:

1. In a two cone extended nozzles rock bit, said bit comprising a pair of extended nozzle legs attached to said bit with a third center jet nozzle in the dome of said bit, wherein said rock bit utilizes the hydraulic action of circulating drilling mud by directing the mud through said nozzles toward the bottom of a hole to aid the process of advancing the bit in said hole, the improvement which comprises:

at least one cavitating jet nozzle body in said rock bit, said body having a first upstream opening formed by said body smaller than a second downstream exit opening, the axis of said nozzle being substantially aligned with the axis of said bit, said body further defining a throat section positioned between said first and second opening, said throat having an opening smaller than said first upstream opening, said throat section being positioned closer to said upstream opening than said downstream exit opening, the diverging walls formed by said nozzle downstream of said throat form a chamber thereby, said at least one nozzle body when subjected to said circulating drilling mud induces cavitation of the mud as it exits past said throat of said nozzle, one of said pair of extended nozzle legs contains said cavitating jet nozzle while the opposing extended nozzle leg contains a non-cavitating nozzle which emits liquid at a higher pressure than the cavitating liquid that passes through said cavitating nozzle, the lower pressure adjacent said cavitating nozzle induces the liquid from said non-cavitating nozzle to move across the rock-tooth interface toward said low pressure area thereby aiding the removal of cuttings from said hole bottom.

2. The invention as set forth in claim 1 wherein a second cavitating jet nozzle is positioned in said dome of said two cone extended nozzle rock bit, said second cavitating nozzle being directed through the cones of said bit, the cavitation induced by said second nozzle cleans said cones reducing the tendency of the cones to ball in said hole.

* * * * *